US006149033A

United States Patent [19]

Poleshuk

[11] Patent Number: 6,149,033

[45] Date of Patent: Nov. 21, 2000

[54] SENSING DEVICE FOR NOZZLE REMOVAL AND REPLACEMENT DETECTION

[75] Inventor: Edward S. Poleshuk, Greensboro, N.C.

[73] Assignee: Marconi Commerce Systems Inc., Greensboro, N.C.

[21] Appl. No.: 09/339,794

[22] Filed: Jun. 24, 1999

[51] Int. Cl.[7] ..... B67D 5/12

[52] U.S. Cl. ..... 222/75

[58] Field of Search ..... 222/71, 74, 75; 141/94

[56] References Cited

U.S. PATENT DOCUMENTS

| | | | |
|---|---|---|---|
| D. 264,471 | 5/1982 | Rowan et al. | D15/9.2 |
| 3,005,476 | 10/1961 | Claus | 141/225 |
| 3,077,212 | 2/1963 | Hearn | 141/209 |
| 3,288,179 | 11/1966 | Romanowski | 141/225 |
| 3,692,212 | 9/1972 | Irie et al. | 222/32 |
| 3,756,630 | 9/1973 | Bickford | 235/151.34 |
| 3,815,784 | 6/1974 | Hansel | 222/26 |
| 4,240,475 | 12/1980 | Schulz | 141/392 |
| 4,503,994 | 3/1985 | Pyle | 222/64 |
| 4,662,539 | 5/1987 | Komukai | 222/14 |
| 4,726,492 | 2/1988 | Komukai | 222/14 |
| 5,110,010 | 5/1992 | Smith | 222/75 |
| 5,363,988 | 11/1994 | Sexton et al. | 222/14 |
| 5,831,861 | 11/1998 | Warn et al. | 364/479.01 |

*Primary Examiner*—Kevin Shaver
*Assistant Examiner*—Melvin A. Cartagena
*Attorney, Agent, or Firm*—Coats & Bennett, P.L.L.C.

[57] ABSTRACT

A fuel dispenser for delivering fuel to a user having a dispenser housing and a fuel delivery system including a storage tank, fuel delivery lines extending from the storage tank to the dispenser housing and a fuel pump. A hose extends from the dispenser housing between the fuel delivery line and includes a nozzle mounted on the hose end opposite the dispenser housing. A receptacle is positioned on the dispenser housing for storing the nozzle when not in use. The receptacle includes a sensor for detecting the presence of the nozzle within the receptacle. The sensor transmits a first signal to the fuel pump when the nozzle is removed from the receptacle resulting in the fuel pump being activated to allow for fuel to flow from the storage tank to the nozzle. The sensor sends a second signal when the nozzle is replaced in the receptacle resulting in deactivating the fuel pump.

29 Claims, 6 Drawing Sheets

SENSING DEVICE FOR NOZZLE REMOVAL AND REPLACEMENT DETECTION

BACKGROUND OF THE INVENTION

Field of the Invention

The present invention relates generally to fuel dispensers and, more particularly, to a fuel dispenser having a sensor for determining the removal and replacement of a fuel nozzle within a dispenser receptacle.

Many localities require a two-step activation process for a fuel dispenser because of local fire code regulations. This two-step process is based on standards established by organizations such as Underwriters Laboratories ("UL") or the National Electric Code. UL Standard 87, "Power-Operated Petroleum Dispensing Devices," establishes a requirement that a motor capable of providing fuel to a nozzle not be started simultaneously with the lifting of the hose or nozzle from its rest position on the dispenser. As a practical matter this requirement creates a two-step dispenser activation process whose first step typically is removing a nozzle from a receptacle and whose second step may take a variety of forms.

Presently, fuel dispensers have used a wide variety of techniques to activate the dispensers upon removal of the nozzle. One technique includes a flap assembly mounted within the nozzle receptacle. The flap assembly is within the receptacle such that the nozzle engages the flap assembly when placed into the receptacle. The movement of the flap assembly moves a magnet on the flap assembly out of proximity of a reed switch, thereby opening a circuit and disabling the dispensing of fuel. When the nozzle is removed from the receptacle, the flap assembly moves within proximity of the reed switch to close the circuit and allow dispensing of the fuel. This embodiment is disclosed in U.S. Pat. No. 5,110,010, hereby incorporated by reference in its entirety.

One drawback of this embodiment is the need for mechanical components within the flap assembly including a nozzle flap, springs, magnet, and flap mounting bracket. Repeated activation and deactivation of the flap assembly may cause fatigue to these parts resulting in failure of the flap assembly, especially considering that many of the fuel dispensers are activated hundreds of times each day. Additionally, many of the fuel dispensers are exposed to weather, and dirt and debris from vehicles which can further interfere with the accuracy and reliability.

These mechanical components also add cost to the dispenser. Each nozzle receptacle must be individually equipped with the components to operate effectively. This cost is magnified for dispensers having multiple hoses and receptacles for each grade of fuel.

Thus, there is a need for a more reliable and cost-effective means of activation and deactivating a fuel dispenser.

SUMMARY OF THE INVENTION

The present invention is directed to sensing the removal and replacement of a nozzle from a fuel dispenser to control the distribution of fuel to a user. The removal of the nozzle results in the fuel pump being activated as the user is preparing to pump fuel. When fueling is complete, the nozzle is returned to the receptacle causing the fuel pump to be shut off.

A first embodiment of the invention includes a fuel dispenser having a pump for delivering fuel from a storage tank through a delivery line. A nozzle having a metallic spout is positioned on the delivery line opposite the storage tank and is housed when not in use within a receptacle mounted on the fuel dispenser. A sensor is positioned at the receptacle for sensing the presence of the metallic spout within the receptacle. The pump is activated when the metallic spout is removed from the receptacle and deactivated when the metallic spout is positioned within the receptacle.

The receptacle may include a spout section for housing the metallic spout when the nozzle is housed within the receptacle. The sensor detects the presence of the metallic spout by a system such as a very low frequency sensor, pulse induction sensor, or beat frequency oscillator sensor. The sensor may be positioned on the receptacle wall, within the receptacle, or within an aperture in the receptacle wall, each position allowing for the sensor to detect when the nozzle is placed and removed in the receptacle. Preferably, the receptacle is constructed of a non-metallic material such as plastic to prevent interference with the sensor.

The fuel dispenser may include a secondary activation means to control the dispensing of fuel. The pump may be activated by a first signal from the sensor and a second signal from the secondary activation means. The secondary activation means may include a push button positioned on the fuel dispenser, a flip switch on the nozzle arm, or a credit card reader. This double activation system prevents inadvertent fuel dispensing and is in accordance with many local fire codes.

A second embodiment of the invention includes a fuel dispenser for pumping fuel including a storage tank, supply lines extending from the storage tank, a fuel pump positioned on the supply lines, a hose extending from the supply lines having a nozzle at an end opposite the supply lines, and a receptacle for housing the nozzle. A sensor is positioned in proximity to the receptacle for sensing the presence of the nozzle within the receptacle. This embodiment further includes a control system in communication with the sensor and the fuel pump. The control system receives a first signal from the sensor when the nozzle is within the receptacle for deactivating the fuel pump and a second signal from the sensor when the nozzle is outside of the receptacle for activating the fuel pump.

This embodiment may also include another input device that works in conjunction with the sensor for operating the fuel pump. The fuel pump is activated when the control system receives a signal from the sensor indicating the nozzle is removed from the receptacle and when the second input device has been activated, such as through a push button, flip switch, and card reader.

Another embodiment of the invention includes a single sensor electronics for controlling the fuel pump for a set of nozzles. This embodiment includes a fuel delivery means for distributing fuel from a storage tank to a dispenser. This dispenser includes a first dispensing location having at least one nozzle attached to the fuel delivery means for dispensing fuel and at least one receptacle for housing the first dispensing location nozzle. A second dispensing location also includes at least one nozzle attached to the fuel delivery means for dispensing fuel and at least one receptacle for housing the second dispensing location nozzle. Each of the receptacles at the dispensing locations include a sensor for detecting the presence of the nozzle within the receptacle. Sensor electronics communicate with each of the sensors and the fuel pump to activate the fuel pump when a nozzle is removed from its receptacle. This embodiment provides for a single sensor electronics to monitor a number of receptacle locations instead of dedicated electronics for each receptacle.

This embodiment may include dispensing locations positioned at various locations on the fuel dispenser, such as nozzle sets on opposite sides to provide for access for more than one user at a given time. The nozzles, receptacles, and sensors for the various dispensing locations may be identically constructed. The sensors may include metal detection systems that sense the presence of a metallic spout on the nozzle by technologies including very low frequency, pulse induction, and beat frequency oscillator.

A method of dispensing fuel is also included within the invention that has fuel delivery means for dispensing fuel from a storage tank. The method includes removing a nozzle from a receptacle positioned on the fuel dispenser. The removal is detected causing a signal being sent to the fuel pump to pump fuel from a storage tank to the nozzle. When the fueling is complete, the nozzle is returned to the receptacle. The sensor detects the nozzle replacement and sends a signal to shut off the fuel pump.

DETAILED DESCRIPTION OF THE PREFERRED EMBODIMENTS

Figure 1:
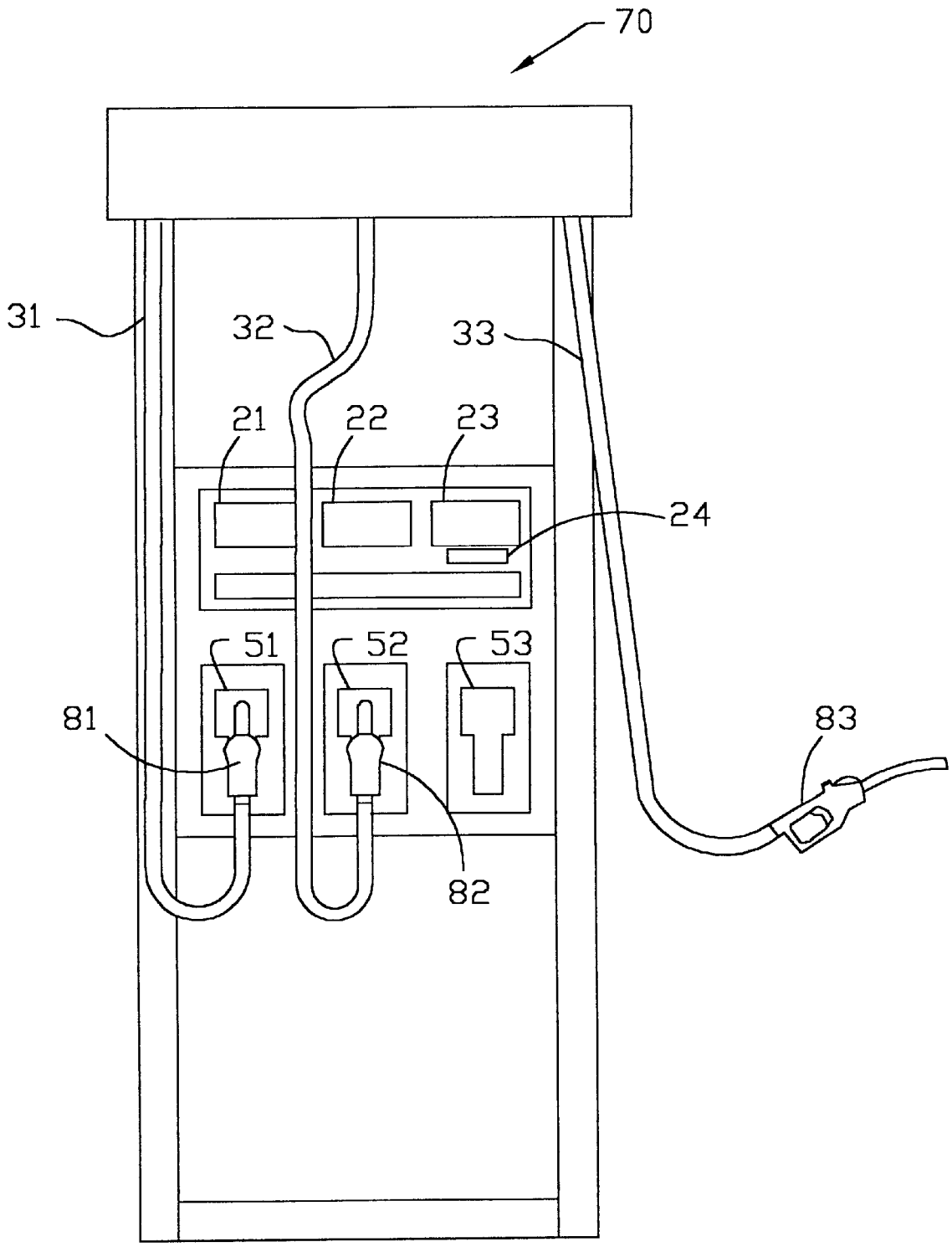
FIG. 1 is a front view of a fuel dispenser having three fuel dispensing hoses and nozzles.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

A fuel dispenser for dispensing a plurality of products is illustrated in FIG. 1. A typical dispenser 70 includes three product hoses 31, 32, 33 having nozzles 81, 82, 83 each of which are mounted on receptacles 51, 52, 53 when not in use. Sales information screens 21, 22, 23 including price per gallon, total sale, gallons, etc. may be positioned on the dispenser to monitor the fuel purchase. A credit card reader 24 or other similar payment input device may be positioned on the dispenser as a means for the user to initiate the fuel purchase.

Figure 2:
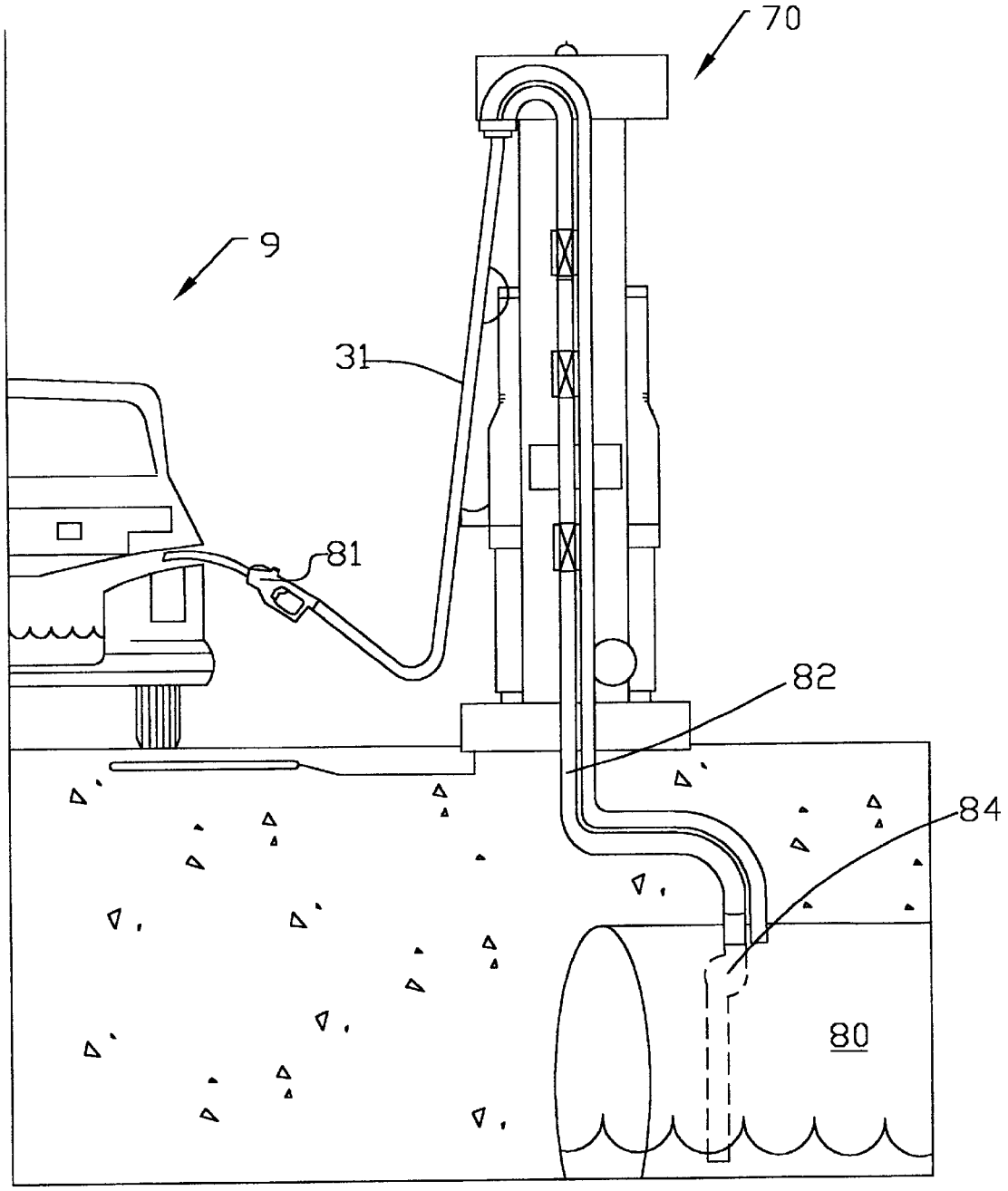
FIG. 2 is a side cross-sectional view of the fuel path within the dispenser from a storage tank, through the dispenser, hose, and nozzle.

The dispenser 70 functions to control the distribution of fuel from a storage tank 80 to the user 9 as illustrated in FIG. 2. Fuel pipes 82 deliver fuel and extend between the storage tank 80 and dispenser 70. Pump 84 is positioned along the input fuel pipe 82 for pumping the fuel from the storage tank 80 to the dispenser 70. FIG. 2 illustrates the fuel pump 84 positioned within the fuel tank 80, however one skilled in the art will understand that the pump may be positioned at a variety of positions along the fuel pipe. Product hose 31 extends from the dispenser 70 to deliver the fuel to the nozzle 81 and ultimately to a vehicle.

In the embodiment illustrated in FIG. 1, each dispenser 70 includes three separate product hoses for delivering fuel. This embodiment is common for delivering three separate octane levels of fuel. Another embodiment (not shown) includes a single receptacle and product hose extending from the dispenser for delivering fuel. Another embodiment includes a second set of product hoses and receptacles positioned on the back side of the dispenser to provide for users to obtain fuel on either dispenser side. These additional dispensing locations have the same hardware including product hoses, nozzles, and receptacles. It is understood that the present invention may be used on fuel dispensers having one or more receptacles for housing a like number of nozzles on either side of the dispenser.

Figure 3A:
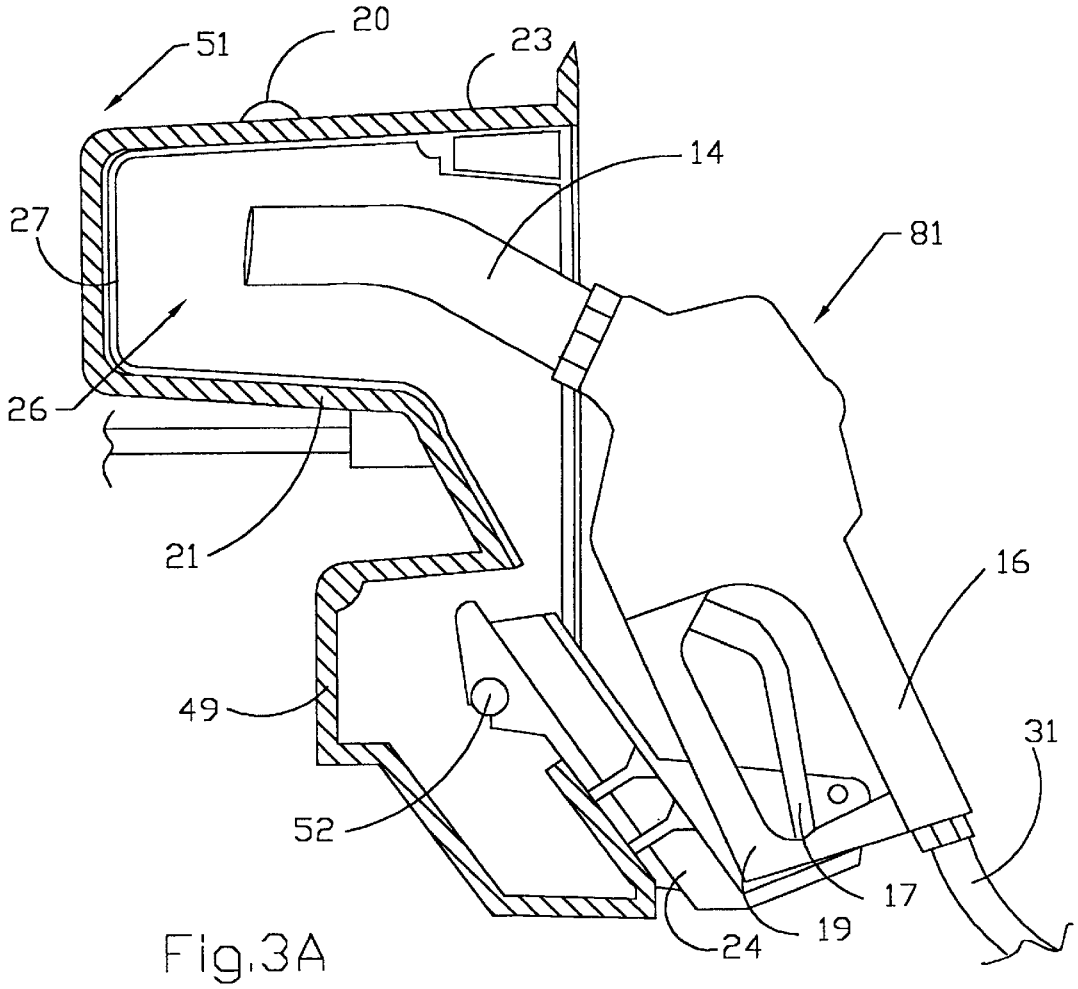
FIG. 3A is a partial sectional view of a dispenser receptacle with a standard nozzle therein and a sensor located on the outside of the receptacle.

FIG. 3A illustrates a side view of nozzle 81 placed within receptacle 51. Nozzle 81 includes a handle and a spout 14 which is inserted into a vehicle's tank during the dispensing process. Preferably, the spout is constructed of a metallic substance that can be sensed by a sensor 20. Alternatively, the spout 14 may include a patch or other attachment that provides for the sensor to detect the presence, but does not require that the entire spout be constructed of a metallic substance. Trigger 17 is movably attached to the nozzle and is actuated by the user to control the fuel rate. Trigger guard 19 extends around the trigger 17 to prevent inadvertent activation of the trigger. Hose 31 attaches to the handle 16 preferably opposite the spout 14.

Receptacle 51 is positioned on the fuel dispenser unit 70 for housing the nozzle 81 when not in use. The receptacle is constructed to position the spout 14 within the receptacle spout section 26, and preferably, in proximity to a receptacle back wall 27. The receptacle 51 includes a spout section 26 for housing the spout 14, and a nozzle support arm 24 for mounting the trigger guard 19 when placing the nozzle 81 in the receptacle. In one embodiment as illustrated in FIG. 3A, the nozzle support arm 24 pivots about a pin 52. When the nozzle is mounted in the receptacle, the nozzle support arm 24 is in the down position. When the nozzle is removed, the user may lift the nozzle support arm 24 to pivot about pin 52 to activate the fuel pump 84, referred to as a flip switch actuator. In an alternative embodiment, a shelf may be positioned on the lower receptacle for resting the trigger guard and positioning the nozzle within the receptacle.

Receptacle 51 is formed by a wall 49 that extends around and forms the receptacle dimensions. Preferably, the receptacle is constructed of a non-metallic material such as plastic so as not to interfere with the accuracy of the sensor 20 and also provide for a more economical fuel dispenser.

Sensor 20 is positioned to detect the presence of the spout 14 within the receptacle 51. As illustrated in FIG. 3A, the sensor maybe positioned on the receptacle's upper edge 23 adjacent to the back wall 27. The sensor may additionally be placed at positions along the receptacle upper edge 23, back wall 27, or lower edge 21 provided the sensor is in proximity with the nozzle spout 14 to sense the presence and absence of the nozzle.

Figure 3B:
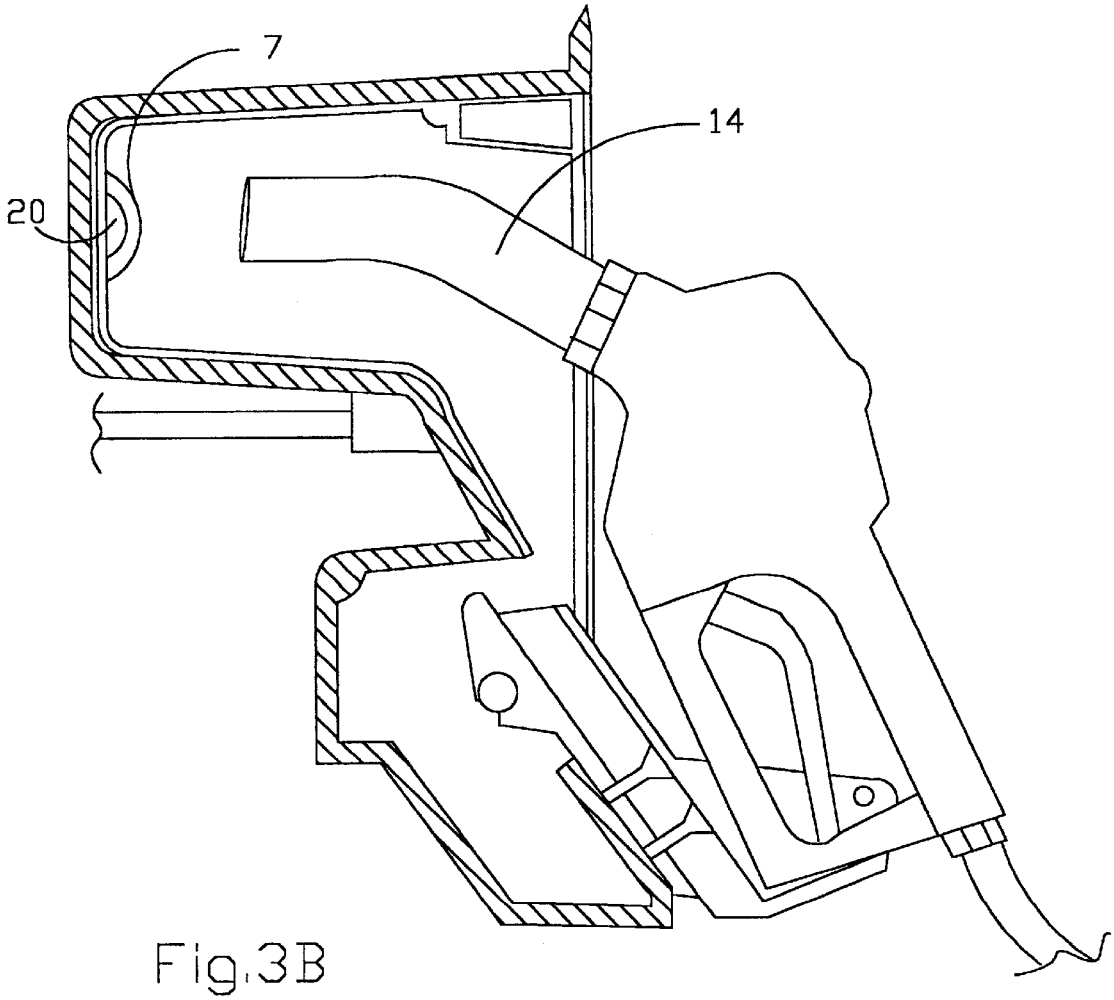
FIG. 3B is an alternative embodiment of the receptacle having the sensor mounted within the receptacle.
Figure 3C:
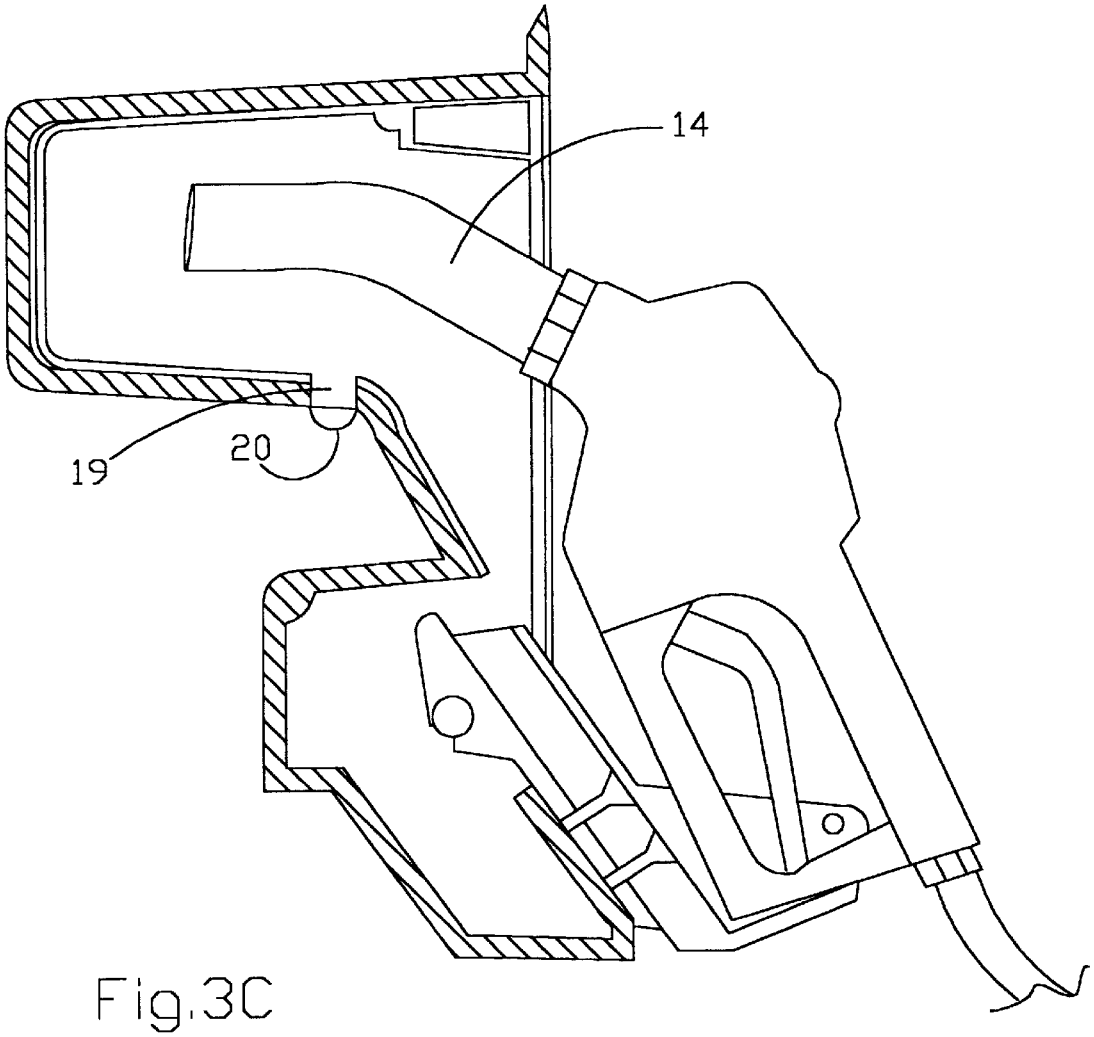
FIG. 3C is a second alternative embodiment of the receptacle having an aperture in the receptacle for mounting the sensor.

Sensor 20 is preferably positioned on the outside of the receptacle to protect the sensor from damage caused by being struck by the spout as it is being removed and replaced from the receptacle as illustrated in FIG. 3A. The sensor placement on the outside of the receptacle allows for the signal to extend through the receptacle to detect the position of the nozzle. In an alternative embodiment as illustrated in FIG. 3B, the sensor 20 is positioned within the receptacle. In this embodiment, the sensor 20 may be protected by a shield or cover 7 to prevent damage by inadvertent contact with the spout 14 or exposure to the dirt and other elements. The cover 7 is constructed of a material that does not hinder the effectiveness of the sensor in detecting the presence of the spout 14. FIG. 3C illustrates an embodiment having an opening 19 within the receptacle wall for mounting the sensor 20. This embodiment provides protection for the sensor 20 by the placement on the outside of the receptacle away from contact with the spout 14.

The sensor 20 may include a number of different technologies for detecting the presence of the metallic spout including very low frequency (VLF), pulse induction (PI), and beat frequency oscillation (BFO).

VLF (Very Low Frequency)

Inside the sensor 20 (sometimes called a search head, coil, antenna, etc.) is a coil of wire called the transmit coil. Electronic current is driven through the coil to create an electromagnetic field. The direction of the current flow is reversed several thousand times every second.

When the current flows in a given direction, a magnetic field is produced whose polarity (like the north and south poles of a magnet) points into the ground; when the current flow is reversed, the field's polarity points out of the ground. The metallic nozzle spout 14 which is placed in proximity of the sensor 20 when placed within the receptacle 51 will have a flow of current induced inside of it by the influence of the changing magnetic field, in much the same way that an electric generator produces electricity by moving a coil of wire inside a fixed magnetic field. This current flow inside a metal object in turn produces its own magnetic field with a polarity that tends to be pointed opposite to the transmit field.

A second coil of wire inside the sensor 20, the receive coil, is arranged (by a variety of methods) so that nearly all of the current that would ordinarily flow in it due to the influence of the transmitted field is cancelled out. Therefore, the field produced by the currents flowing in the nearby metal object will cause currents to flow in the receive coil which may be amplified and processed by the metal detector's electronics without being swamped by currents resulting from the much stronger transmitted field.

The resulting received signal will usually appear delayed when compared to the transmitted signal. Delay is due to the tendency of conductors to impede the flow of current (resistance) and to impede changes in the flow of current (inductance).

P.I. (Pulse Induction)

A typical PI sensor contains a single coil of wire which serves as both the transmit and receive coil. The transmitter operates in a manner similar to an automobile ignition system. Each time a pulse of current is switched into the transmit coil it generates a magnetic field. As the current pulse shuts off, the magnetic field around the coil suddenly collapses. When this happens, a voltage spike of a high intensity and opposite polarity appears across the coil. This voltage spike is called a counter electromotive force, or counter emf. In an automobile it is the high voltage that fires the spark plug. The spike is much lower in intensity in a PI metal detector, usually about 100 to 130 volts in peak amplitude. It is very narrow in duration, usually less than 30 millionths of a second. In a PI metal detector it is called the reflected pulse.

When a metal object nears the loop it will store some of the energy from the reflected pulse and will increase the time it takes for the pulse to decay to zero. The change in the width of the reflected pulse is measured to signal the presence of a metal target.

The amplified signal coming from the receiver is connected to a switching circuit which samples the reflected portion of the pulse as it reaches zero. The reflected pulse up to this point references in actuality a series of pulses at the transmit frequency. When a metal object nears the coil the transmit portion of the signal will remain unchanged while the reflected portion of the pulse will become wider. The metal object stores some of the electrical energy from the transmit pulse and increases the time it takes for the reflected pulse to reach zero. An increase in duration of a few millionths of a second is enough to allow the detection of a metal target. The reflected pulse is sampled with an electronic switch controlled by a series of pulses which are synchronized with the transmitter.

BFO (Beat Frequency Oscillator)

BFO (Beat Frequency Oscillator) sensors use two oscillators, each of which produces a radio frequency. One of these oscillators uses a coil of wire that we call the search loop. The second oscillator uses a smaller coil of wire and is called the reference oscillator. By adjusting the oscillators so their frequencies are very nearly the same, the difference between them produces a beat note, this beat note changes slightly when the search loop is near a piece of metal. Removing metal from the vicinity of the search loop will cause the beat note to return to normal. The beat note can be made to disappear when the frequencies of the two oscillators are about equal.

Another method of metal detection used to signal nozzle removal in Advantage™ pumps and dispensers constructed by Gilbarco, Inc. of Greensboro, N.C. consists of using a magnetic field to create continuity in the proximity switch located on the receptacle 51. Current flows to the control board where the signal is interpreted to mean the nozzle has been removed from the receptacle 51. The circuit for the metal detecting system selected for use in fuel dispensing systems for the detection of nozzle removal may include an electronic switch (mechanical or solid state) which can be electronically controlled to either impede or allow current flow to the control board.

Figure 4:
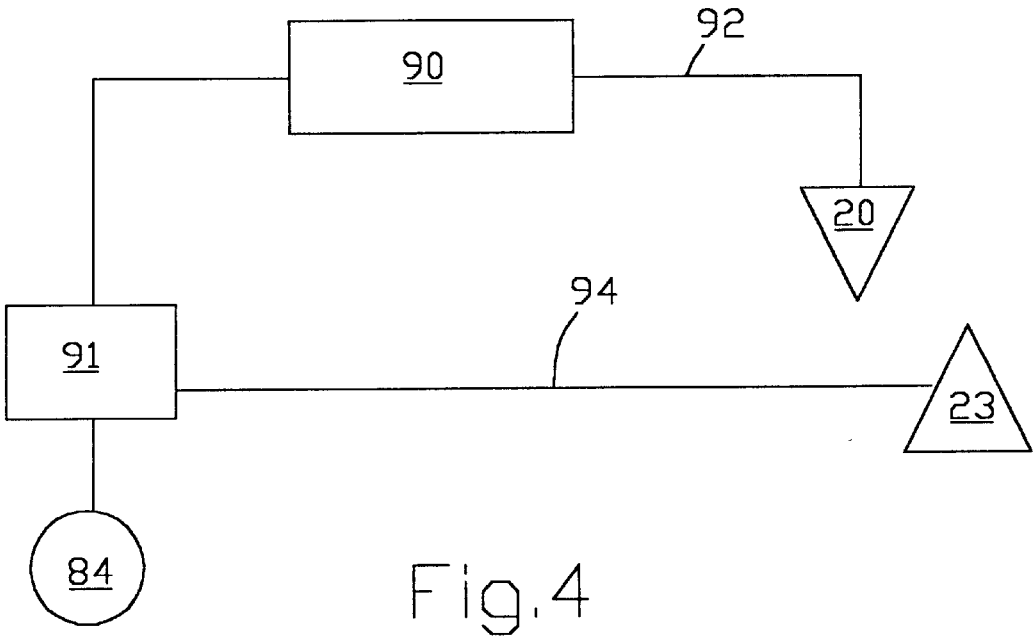
FIG. 4 is a schematic diagram illustrating a two signal activation system.

Referring now to FIG. 4, sensor electronics 90 maybe positioned locally for each receptacle location to transmit and receive signals sent through the sensor 20. The sensor electronics 90 are used to monitor any change to the signal or absence of a signal from the sensor 20 indicating the nozzle 81 has been removed or returned to the receptacle 51. A control system 91 controls the distribution of fuel through the dispenser and receives signals from the sensor electronics 90. Upon receipt of a signal or the change of a signal 92 indicating that the nozzle has been removed, the control system 91 will recognize the change in nozzle position. The embodiment illustrated in FIG. 4 requires a secondary activation means 23 to signal the control system 91 to activate the fuel pump 84. Upon a receipt of both signals, the control system 91 activates the fuel pump 84 to allow fuel to flow through the dispenser to the user. Once the user has completed the fueling process, the nozzle 81 is replaced within the receptacle 51. The sensor 20 again detects the presence of the spout 14 resulting in the control system 91 deactivating the fuel pump. In one embodiment not illustrated, the control system may activate the fuel dispenser without the need for a secondary activation means 23 based on the nozzle position detected using sensor 20.

The signal received from the secondary activation means 23 may include a variety of activation methods including a push button on the dispenser face, flipping the nozzle support arm 24 about the pin 52 after nozzle removal from the receptacle, inserting a valid credit card number into an input screen on the dispenser face, etc. The order of the signals 92, 94 received by the control member 90 is not imperative for activation of the fuel pump. As with the first embodiment, replacement of the nozzle 81 within the receptacle 51 causes the fuel pump to deactivate.

Figure 5:
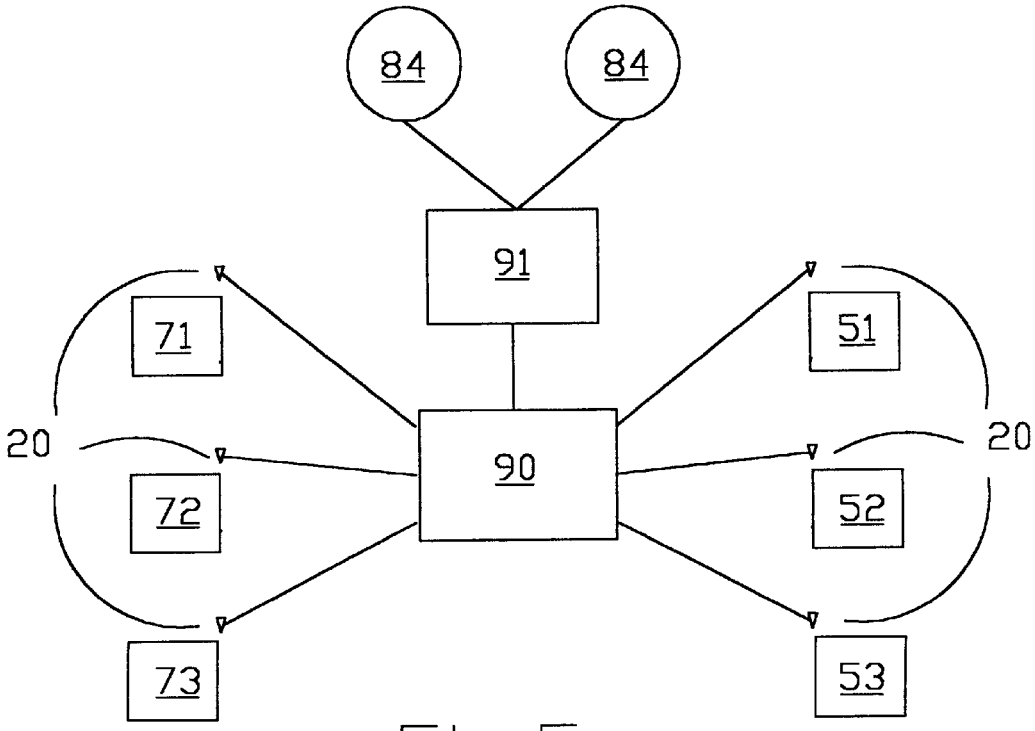
FIG. 5 is a schematic diagram of a single control system having sensor electronics in communication with multiple receptacle locations each having a sensor.

FIG. 5 illustrates an alternative embodiment of a single dispenser unit having multiple receptacles 71, 72, 73, 51, 52, 53, each being equipped with a nozzle for dispensing fuel. This arrangement is typically used in a dispenser having three separate octane levels that may be dispensed from each side of the dispenser. Each receptacle is equipped with a sensor for indicating the presence and absence of the nozzle from the receptacle. Each dispenser includes single sensor electronics 90 and control system 91 to activate the fuel pump for dispensing fuel to the user. This embodiment may include a single fuel pump per dispenser, or separate fuel pumps for each dispenser side as illustrated in FIG. 5. The sensor electronics 90 are capable of monitoring both sides of the dispenser thereby providing a cost savings by reducing the requirement of dedicated electronics for each receptacle.

In use, the dispenser is inactive as the fuel pump is off and the nozzles are housed within the receptacles. A user removes the nozzle 81 from the receptacle 51 causing the sensor 20 to register a change or absence in the electric field within the receptacle. The sensor electronics 90 monitors this change or absence in the electric field and signals a control system 91 indicating nozzle removal. The control system 91 can either activate the fuel pump to allow for fuel to be distributing from a storage tank 80 to the user, or may require a second signal from the user prior to powering the fuel pump. Once the control system 91 receives the predetermined signals, the fuel pump is activated allowing the user to control the fuel delivery by actuating the nozzle trigger 17. When the user finishes, the nozzle is replaced into the receptacle. Sensor electronics 90 registers replacement of the nozzle signaling the control system to shut down the fuel pump as the fueling process is complete.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. An apparatus for activating a fuel dispenser comprising:

a pump for delivering fuel from a storage tank through a delivery line;

a nozzle positioned on said delivery line, said nozzle having a metallic spout;

a receptacle attached to the fuel dispenser for removably housing said nozzle; and a sensor positioned at said receptacle for sensing the presence of said metallic spout within said receptacle, said pump being activated when said metallic spout is removed from said receptacle and being deactivated when said metallic spout is positioned within said receptacle.

2. The apparatus of claim 1, wherein said receptacle includes a spout section for housing said metallic spout when said nozzle is housed within said receptacle, said sensor being positioned within said spout section.

3. The apparatus of claim 2, wherein said receptacle is constructed of a non-metallic material.

4. The apparatus of claim 3, wherein said receptacle is constructed of plastic.

5. The apparatus of claim 1, further including a secondary activation means positioned on the dispenser, said pump being activated by a first means from said sensor and a second signal from said secondary activation means.

6. The apparatus of claim 5, wherein said secondary activation means is selected from the group consisting of a push button, a flip switch, and a credit card reader.

7. The apparatus of claim 5, wherein the flow of fuel to a user after the activation of said pump is controlled by a trigger positioned on said nozzle.

8. The apparatus of claim 1, wherein said sensor is selected from the group consisting of very low frequency, pulse induction, and beat frequency oscillator.

9. The apparatus of claim 1, wherein said sensor is positioned within said receptacle for sensing the presence of said metallic nozzle.

10. The apparatus of claim 1, wherein said receptacle includes an aperture for mounting said sensor for sensing the presence of said metallic nozzle.

11. An apparatus for dispensing fuel comprising:

a fuel dispenser for pumping fuel having a storage tank, supply lines extending from said storage tank, a fuel pump positioned on said supply lines, a hose extending from said supply lines having a nozzle at an end opposite said supply lines, and a receptacle for housing said nozzle;

a sensor positioned in proximity to said receptacle for sensing the presence of said nozzle within said receptacle; and a control system in communication with said sensor and said fuel pump, said control system receiving a first signal from said sensor when said nozzle is within said receptacle for deactivating said fuel pump and receiving a second signal from said sensor when said nozzle is outside of said receptacle for activating said fuel pump.

12. The apparatus of claim 11, further including a second activation device for sending a third signal to said control system to activate said fuel pump.

13. The apparatus of claim 12, wherein said control system activates said fuel pump upon the receipt of said second signal means indicating said nozzle is removed from said receptacle and said third signal from said second input device.

14. The apparatus of claim 13, wherein said second input device is selected from the group consisting of a push button, a flip switch, and a card reader.

15. The apparatus of claim 11, wherein said nozzle includes a spout constructed of a metallic material, said spout being positioned within said receptacle when said nozzle is housed within said receptacle.

16. The apparatus of claim 15, wherein said sensor detects the presence of said metallic spout within said receptacle via a detection device selected from the group consisting of a very low frequency, a pulse induction, and a beat frequency oscillator.

17. A fuel dispenser comprising:

a fuel delivery means for dispensing fuel from a storage tank;

a first dispensing location having at least one nozzle attached to said fuel delivery means for dispensing fuel and at least one receptacle for housing said first dispensing location nozzle;

a second dispensing location having at least one nozzle attached to said fuel delivery means for dispensing fuel and at least one receptacle for housing said second dispensing location nozzle;

a sensor positioned at each of said receptacles within each of said first dispensing location and said second dispensing location, each of said sensors detecting the presence said nozzle within said receptacle; and sensor electronics in communication with each of said sensors and said fuel pump, said sensor electronics receiving a signal from said sensor indicating the presence of said nozzle to control said fuel pump.

18. The apparatus of claim 17, wherein said first and second dispensing locations are positioned on opposite sides of the fuel dispenser.

19. The apparatus of claim 17, wherein said nozzles further include a metallic spout that extends into said receptacle when said nozzle is housed in said receptacle.

20. The apparatus of claim 19, wherein said sensor detects the presence of said metallic spout and is selected from the group consisting of very low frequency, pulse induction, and beat frequency oscillator.

21. The apparatus of claim 17, wherein said nozzles, receptacles, and sensors are constructed the same within each of said first and second dispensing locations.

22. The apparatus of claim 17, wherein said sensor electronics activate a first fuel pump for delivering fuel to said nozzles of said first dispensing location, and a second fuel pump for delivering fuel to said nozzles of said second dispensing location.

23. The apparatus of claim 17, further including a control system positioned within the fuel dispenser, said control system receiving signals from said sensor electronics to activate and deactivate said fuel delivery means.

24. A system for controlling the distribution of fuel through a fuel dispenser comprising:

a dispenser housing;

a fuel delivery system having a storage tank, fuel delivery lines extending from said storage tank to said dispenser housing, and a fuel pump;

a hose having a first end extending from said dispenser housing and connected to said fuel delivery line and a second end having a nozzle;

a receptacle positioned on said dispenser housing for mounting said nozzle;

a sensor positioned about said receptacle for detecting the presence of said nozzle within said receptacle; and sensor electronics in communication with said sensor and said fuel pump to control the activation of said fuel pump, wherein said sensor transmits a first signal to said sensor electronics when said nozzle is removed from said receptacle resulting in said fuel pump being activated to allow for fuel to flow from said storage tank to said nozzle, said sensor sending a second signal when said nozzle is replaced in said receptacle resulting in said sensor electronics deactivating said fuel pump.

25. A fuel dispenser comprising:

fuel delivery means for dispensing fuel from a storage tank through a fuel delivery line to a nozzle for distribution to a user;

a receptacle for housing said nozzle; and sensor means for detecting said nozzle within said receptacle, said sensor means sending a signal to said fuel delivery means to dispense fuel when said nozzle is absent from said receptacle.

26. A method of controlling the dispensing of fuel from a fuel dispenser comprising the steps of:

removing a nozzle from a receptacle positioned on the fuel dispenser;

detecting the removal of the nozzle from the receptacle;

signaling a fuel pump to pump fuel from a storage tank to the nozzle;

activating the nozzle to control the rate of fuel flowing through the fuel dispenser;

replacing the nozzle into the receptacle;

detecting the replacement of the nozzle back into the receptacle; and signaling the fuel pump to shut off.

27. An apparatus for dispensing energy comprising:

an energy dispenser having a storage chamber, supply lines extending from said storage chamber, a transfer mechanism positioned on said supply lines, a hose line extending from said supply lines having a nozzle, and a receptacle for housing said nozzle;

a sensor positioned in proximity to said receptacle for sensing the presence of said nozzle within said receptacle; and a control system in communication with said sensor and said transfer mechanism, said control system receiving a first signal means from said sensor when said nozzle is within said receptacle for deactivating said transfer mechanism and receiving a second signal means from said sensor when said nozzle is outside of said receptacle for activating said transfer mechanism.

28. The apparatus of claim 27, wherein said nozzle includes a spout constructed of a metallic material, said spout being positioned within said receptacle when said nozzle is housed within said receptacle.

29. The apparatus of claim 28, wherein said sensor detects the presence of said metallic spout within said receptacle via a detection device selected from the group consisting of a very low frequency, a pulse induction, and a beat frequency oscillator.

* * * * *